US005749400A

United States Patent [19]

Pascual

[11] Patent Number: 5,749,400

[45] Date of Patent: May 12, 1998

[54] PROCESS FOR THE MANUFACTURE OF A FIGURED ELASTIC FABRIC MADE BY THE JACQUARD SYSTEM

[75] Inventor: D. Samual Botella Pascual, Alicante, Spain

[73] Assignee: M. Hidalgo Beistequi, S.A., Alicante, Spain

[21] Appl. No.: 712,568

[22] Filed: Sep. 11, 1996

Related U.S. Application Data

[63] Continuation-in-part of Ser. No. 357,998, Dec. 16, 1994, abandoned.

[30] Foreign Application Priority Data

Dec. 16, 1993 [ES] Spain ..... 92 02 608

[51] Int. Cl.[6] ..... D03D 15/08

[52] U.S. Cl. ..... 139/421; 28/167; 26/51; 139/422; 442/182

[58] Field of Search ..... 28/167; 26/51, 26/18.5; 139/1 R, 421, 422, 423; 428/231; 442/182

[56] References Cited

U.S. PATENT DOCUMENTS

| | | | |
|---|---|---|---|
| 1,663,303 | 3/1928 | Hirsch | 139/421 |
| 1,960,444 | 5/1934 | Linke | 139/421 |
| 2,184,751 | 12/1939 | Nathanson et al. | 139/421 |
| 2,254,339 | 9/1941 | Wylde et al. | 139/421 |
| 3,604,474 | 9/1971 | Kamei | 139/396 |
| 3,948,702 | 4/1976 | Theissen | 28/165 |
| 4,156,955 | 6/1979 | Joy | 26/18.6 |

FOREIGN PATENT DOCUMENTS

| | | | |
|---|---|---|---|
| 1179727 | 5/1959 | France | 139/421 |

*Primary Examiner*—Andy Falik
*Attorney, Agent, or Firm*—Foley & Lardner

[57] ABSTRACT

A combination of rigid, non-elastic wefts with other wefts which are elastic and much thinner allows the creation of a figured, elastic fabric. The floats of the elastic wefts may be stretched between points of bindings. It is the density of the elastic threads along with the length of the elastic weft floats which determines the fabric's elasticity. This ratio is retained throughout the width of the material. Once the weaving process is completed, the fabric undergoes a process which takes place in a tenter subject to temperatures in excess of 100° C., saturated in wet steam. This process acts on the elastic wefts, increasing their elasticity by 100%.

17 Claims, 5 Drawing Sheets

PROCESS FOR THE MANUFACTURE OF A FIGURED ELASTIC FABRIC MADE BY THE JACQUARD SYSTEM

This application is a continuation-in-part application of U.S. Ser. No. 08/357,998, filed Dec. 16, 1994, now abandoned.

BACKGROUND OF THE INVENTION

1. Field of the Invention

The invention referred to in the course of this specification is for a new process for the manufacture of a figured, elastic fabric, i.e., an elastic fabric with designs in relief, of diverse colors or of a single color in different shades. The reliefs are provided by varying fabric density.

2. Related Art

Current techniques for creating elastic fabrics produce fabrics which are plain, not figured. A figured fabric is one which has a pattern in relief woven into the fabric. Conventional elastic fabrics are plain, without relief of any sort.

Conventional elastic fabrics are manufactured with circular machines, which create tubular fabrics. The procedure for making such fabrics is, by its nature, incapable of producing a figured, elastic fabric. Conventional elastic fabrics are very different in structure and design from the figured, elastic fabric produced by the present invention.

Non-elastic, figured fabric may be manufactured by the Jacquard system, however a need exists for a figured, elastic fabric and a method of manufacturing the same, A further need exists for a method of producing a figured, elastic fabric which is produced in longitudinal sections which are easily used to make a variety of garments, linings or in other applications.

SUMMARY OF THE INVENTION

To meet the above stated needs and others, it is an object of the present invention to provide a figured, elastic fabric and a method of making the same.

It is a further object of the invention to provide a method of making a figured, elastic fabric in longitudinal sections which are easily used in any fabric application.

To meet the above stated objects, the present invention may comprise the steps of:

- preparing a design program for a fabric to be woven on a loom;
- providing weft and warp threads to be used by said loom;
- wherein a majority of said weft threads are made of elastic material and a minority of said weft threads are made of non-elastic material;
- providing tension on said weft threads said tension is sufficient to stretch said elastic weft threads;
- shedding and interlacing said warp and weft threads on said loom according to said design program; and
- providing floats in said elastic weft threads throughout said fabric according to said design program.

Additional objects, advantages and novel features of the invention will be set forth in the description which follows or may be learned by those skilled in the art through reading these materials or practicing the invention. The objects and advantages of the invention may be achieved through the means recited in the attached claims.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF AN EMBODIMENT OF THE INVENTION

With reference to the drawings, an embodiment of the present invention will now be described.

Figure 1:
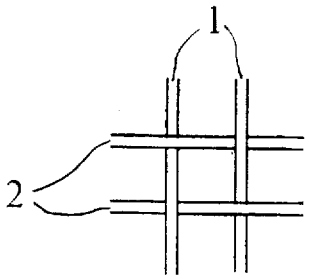
FIG. 1 PRIOR ART
FIG. 1 illustrates the conventional relationship between weft and warp threads in a woven fabric.

A shown in FIG. 1, a weave in a woven fabric may consist of two warp threads 1 and two weft threads 2 which are interlaced with each other. Each weft thread 2 passes alternately over and under each warp thread 1. Any two adjacent weft threads 2 alternate in this manner in opposition to each other. Similarly each warp thread 1 alternates over and under each weft thread 2, with adjacent warp threads 1 alternating opposite to each other.

Figure 2:
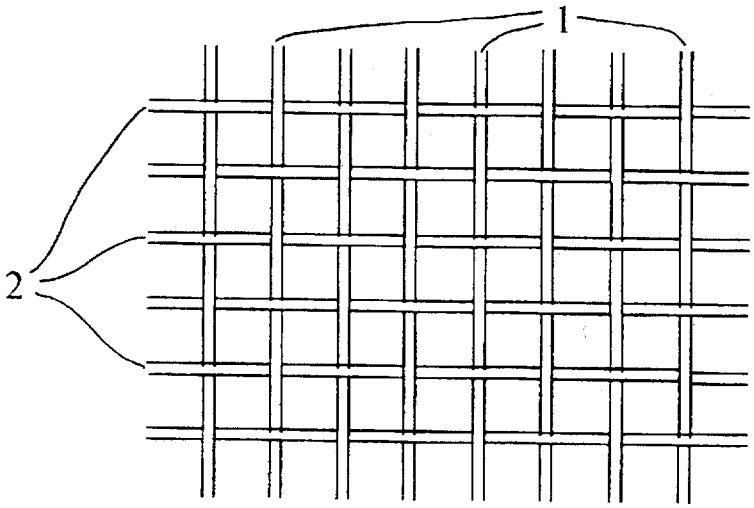
FIG. 2 PRIOR ART
FIG. 2 also illustrates the conventional relationship between weft and warp threads, showing a larger section of woven fabric.

FIG. 2 illustrates how this basic weave can be expanded to create a large, simple fabric lacking relief or design. In FIG. 2, a plurality of weft threads 2 are interwoven with a plurality of warp threads 1 in the same manner described above.

Figure 3:
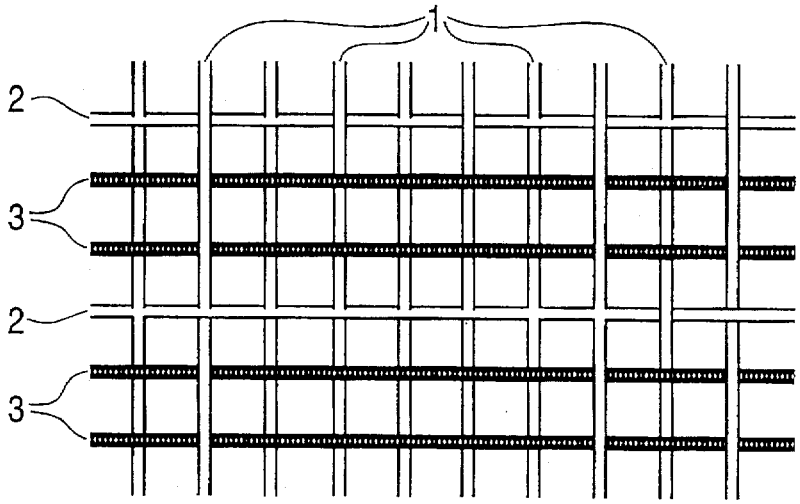
FIG. 3 shows a woven fabric according to the principles of the present invention where the majority of the weft threads are elastic.

In FIG. 3, a weft thread of elastic material 3 has been substituted for one of the ordinary, non-elastic weft threads 2. According to the principles of the present invention, elastic weft 3 is woven into the fabric while being stretched or pulled taut. The greater the tension placed on elastic weft 3 during weaving, the more elastic will be the finished fabric having a plurality of elastic wefts interwoven with non-elastic wefts 2. Thus the elasticity of the finished fabric can be determined to suit the needs of an intended use of the fabric by adjusting the tension on the elastic weft 3 during weaving.

Figure 4:
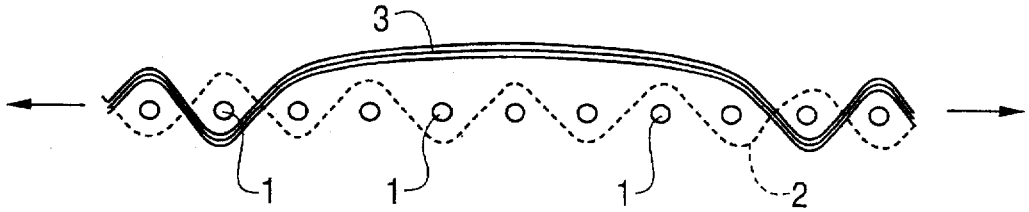
FIG. 4 shows a woven fabric according to the principles of the present invention.

As best seen in FIG. 4, the elastic weft 3 of FIG. 3 is not alternately interwoven among the warp threads 1 in the manner of the prior art as shown in FIG. 2. Rather than passing alternately above and below each succeeding warp thread 1, the elastic weft 3 "floats" or "loops" i.e. remains on the same side of the fabric passing over or under a plurality of warp threads 1. The points at which the elastic weft 3 begins or ends a float may be called a binding or a point of binding.

Figure 5:
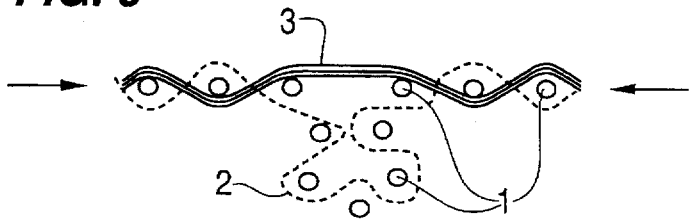
FIG. 5 shows a woven fabric according to the principles of the present invention.

As indicated by the arrows in FIG. 4, elastic weft thread 3 is woven into the fabric under a constant tension. FIG. 5, shows the fabric woven in FIG. 4 after the tension has been released from elastic weft thread 3.

When the tension is released, the elastic weft thread 3 contracts. This causes the non-elastic warp threads 2 and the non-elastic weft threads 1 to bunch together in the area where the elastic weft thread 3 was floated. This bunching of non-elastic threads creates the figuring or relief of the fabric according to the principles of the present invention.

Accordingly, by controlling the position and length of the floats in a plurality of elastic weft threads 3, which are interwoven with non-elastic weft threads 2 and warp threads 1, a design or pattern can be created in relief in an elastic fabric. The more elastic wefts 3 are used in the fabric, the more elastic the fabric will be. The longer the floats are in the elastic wefts 3, the more elastic the fabric will be and the higher will be the design in relief.

Thus, to manufacture an elastic figured fabric according to the present invention, rigid, non-elastic wefts are combined with much thinner elastic wefts. The combination and ratio of elastic to non-elastic wefts depends on the design to be figured and the desired elasticity of the fabric.

In each case, the proportion of elastic and non-elastic wefts required is a result of the prior technical study of the desired fabric design. The density of the elastic threads plus the length of the elastic weft floats are the decisive factors in determining the fabric's elasticity.

When the figured fabric of the present invention is removed from the loom, the floats of the elastic threads referred to above cause the fabric to contract. This contraction creates loops in the rigid (non-elastic) wefts. Due to the contraction of the elastic wefts which tend at all times toward a rest (or contracted) position, the gathered non-elastic wefts and warps form the desired figured design in terms both of pattern and elasticity.

When the fabric is stretched, it becomes wider, sometimes even twice its original width, thus reducing or virtually straightening the bunching of the non-elastic wefts and warps. If the necessary elastic wefts are provided, along with the appropriate weaves, the fabric returns to its technically designed initial width when it is allowed to contract.

It is within the scope of the present invention to note that the elastic, figured fabric may also be attained by a combination of elastic and non-elastic warps rather then wefts. In this case, the elastic threads are applied as warp threads in the required proportion and the fabric may be stretched along its length rather than its width. Additionally, the figured fabric may be constructed to stretch along both its width and its length. In this two-way stretch type fabric, the combination of elastic and non-elastic threads are used in both the weft and warp.

In manufacturing a figured, elastic fabric, a pattern is first prepared with the same technical specifications as for a normal (non-elastic) fabric. Then, using those specifications, the weaves for the fabric are changed to produce an optimal result with the insertion of certain special elastic-type wefts.

Thus, the material's initial weaves are changed and the pattern is also changed to include a further weave which provides the elasticity required according to the elastic wefts inserted into the whole fabric. It is these elastic wefts, by means of such weave, which act on the fabric to give it elasticity.

According to preliminary studies, to obtain a desired level of elasticity on the basis of the weaves, 2 elastic wefts for each non-elastic weft are to be inserted. This ratio is maintained throughout the entire width of the fabric so that such elastic wefts completely dominate over the rigid weft and over the warp, thus giving the fabric the desired elasticity.

Figure 6:
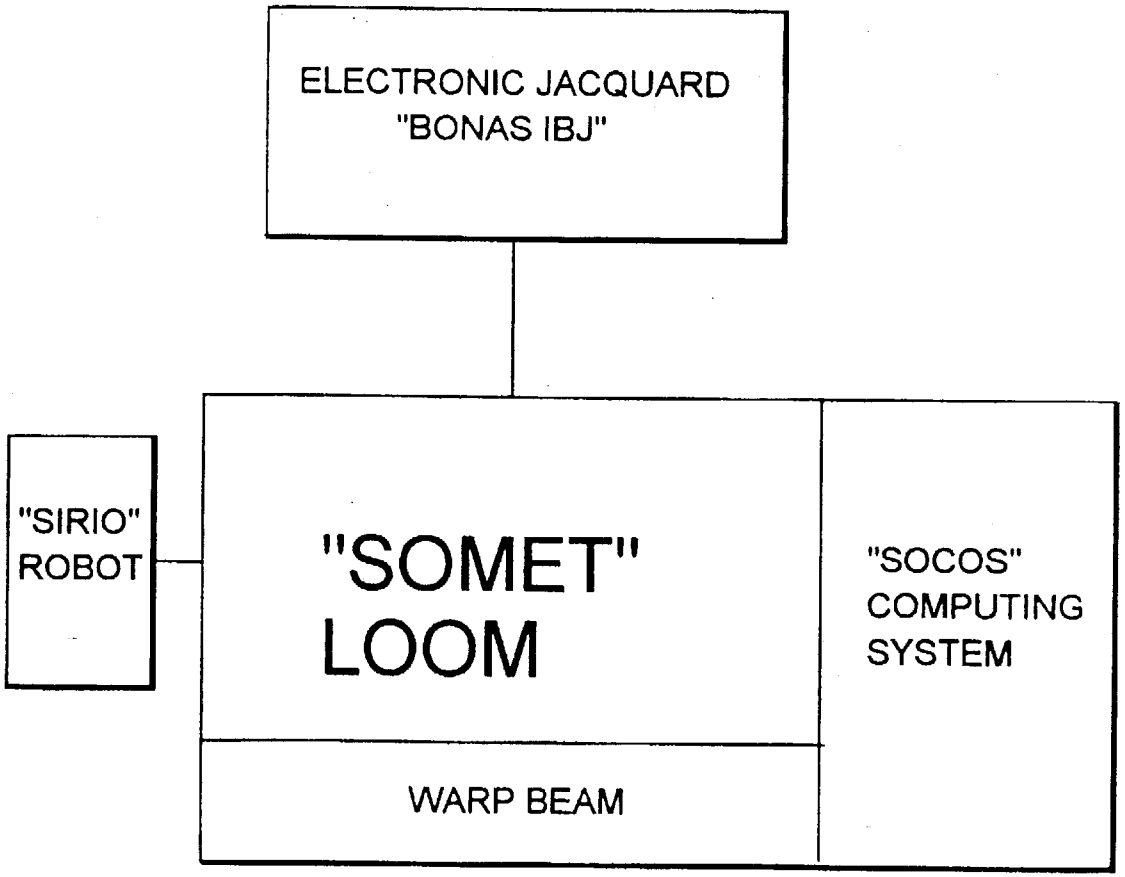
FIG. 6 shows an exemplary weaving system for practicing the method of the present invention.

FIG. 6 illustrates a loom and supporting devices on which the principles of the present invention may be practiced. First, all the warp threads are prepared as is normally done in any loom for the manufacture of any non-elastic fabric. An older jacquard system requires a jacquard card as a design program which has been prepared to program the loom to produce the desired design in the fabric. In practicing the present invention, a design card is prepared in the same way cards are prepared for non-elastic fabrics. However, the artisan preparing the card must consider which wefts or warps will be elastic and how this will produce the desired design.

The jacquard machine will then read the card and accordingly prepare the shedding for each pick made by the dart. In the case of a modern loom and jacquard system which are electronic, a computer disk replaces the traditional design card as the design program.

When the process of weaving is begun the loom automatically selects the appropriate thread of weft and offers it to the dart which will weave it to the other side of the loom through the shedding provided by the jacquard machine in response to the design card. The dart will pick the thread offered by the loom accordingly to the design of the fabric. The thread can be elastic or not and of course can be of different colors and materials. The weft threads are fed by an electronic robot which automatically controls the tension of the thread. It is important to note that, for example, the tension on all the threads, elastic and non-elastic, is the same so that the elastic threads are stretched.

The process may be practiced using known weaving equipment. As shown, for example, in FIG. 6, the loom used is a standard "SOMET" model "THEMA 11 Excel" including a computing system called "SOCOS" that controls all characteristics of the process and specifically the warp tension through the Electronic Warp Control device (EWC). The shedding system is an electronic Jacquard called "BONAS IBJ" with 1344 pins. And the "SIRIO" robot, represented at the left, is a weft pre-feeder with automatic speed and tension adjustment.

The shedding is determined by the electronic Jacquard machine which controls electronically the shedding of each pick. The shedding range is between 3 and 9 centimeters, preferably 4 cm, and is independent of whether the weft is elastic or non-elastic. We use only 1320 of the total 1344 pins.

In order, the steps of the process of the manufacture would be as follows:

1) First, prepare the jacquard card which will be used by the jacquard machine to correctly make the appropriate design for the fabric. The card reflects the idea that the textile designer has about the fabric. Using the card (or computer disk) the designer chooses how each thread must be woven in order to make a particular design, as well as how to weave the elastic treads in order to get the desired elasticity and so that the fabric makes the desired pleats. It must be remembered that the elastic threads do take part in the design.

2) The appropriate threads are then chose. For example:

Warp: 36 ends/cm. A polyester textured Tanglin 167/64/2 is used for warp.

Weft: 26 ends/cm (also the No. of picks is 26). One pick is of acrylic color 2/40 Nm. and two are of elastomer 110 Dtex.

3) Each warp thread must be prepared in the loom. The loom, for example, is a standard "SOMET" model "THEMA 11 Excel", including a computing system called "SOCOS" which controls all the characteristics of the process and specifically the warp tension through the Electronic Warp Control device (EWC). In this example, the tension given to the thread by the EWC is 250%.

4) The shedding system is an electronic Jacquard called "BONAS IBJ" with 1344 pins. The warp threads are passed through the needles or pins of the jacquard machine, which has 1,344 needles, of which we use 1,320. The jacquard machine will read the card and accordingly prepare the shedding for each pick made by the dart. In this example, both the loom and the jacquard machine are electronic so instead of using a card a computer disk is needed as the design program.

5) When the process of weaving is begun the loom automatically selects the appropriate thread of weft and offers it to the dart which will weave it to the other side of the loom through the shedding left by the jacquard machine on each pick. In this example, the shedding could vary from 3 to 9 cm, but is preferably 4 cm.

6) The dart will pick the thread offered by the loom accordingly to the design of the fabric. The thread can be elastic or not and of course can be of different colors and materials. The weft threads are fed by an electronic "SIRIO" robot, which is a weft pre-feeder with automatic speed and tension adjustment. It is important to note that, in this case, the tension of all the threads, elastic or not, is the same, so that the elastic threads are stretched.

7) Repeating this process, a fabric is obtained which will have a certain elasticity depending on how many elastic weft threads, have been used. After weaving, the fabric will obviously reduce its length by a certain amount, depending on the number of elastic threads, when it is removed from the loom.

8) The fabric is then removed from the loom.

Figure 7:
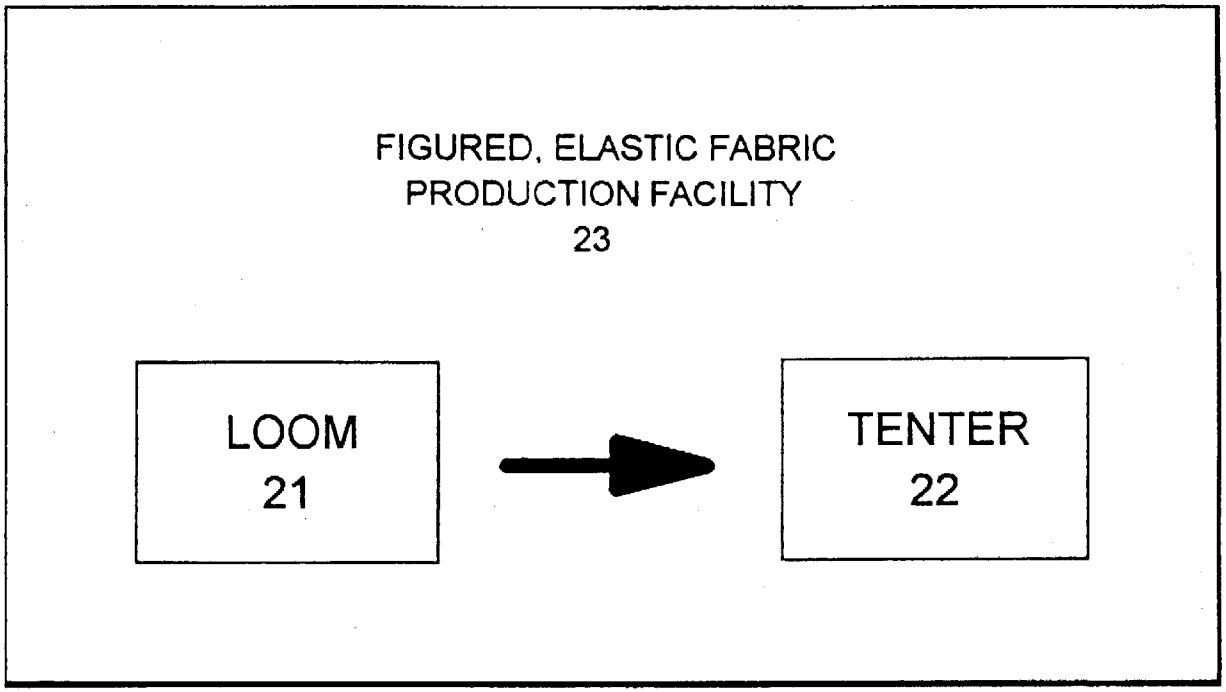
FIG. 7 shows a block diagram of the weaving and steaming process used to complete the figured fabric of the present invention.
Figure 8:
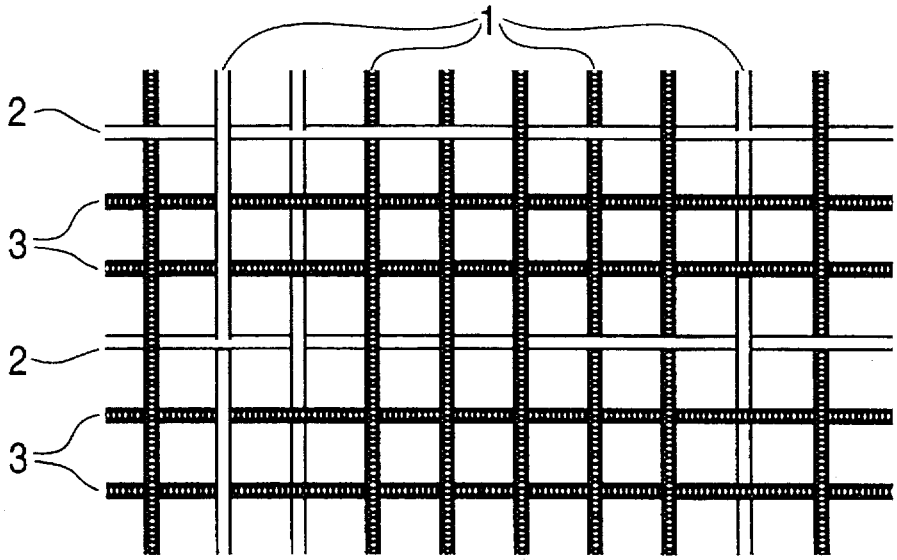
FIG. 8 shows the FIG. 3 fabric where the majority of the warp threads are also elastic.

Once weaving is completed, such fabrics already have a certain degree of elasticity. As shown in FIG. 7, the process for producing an elastic, figured fabric may be carried out in an elastic figured fabric production facility 23, which includes a loom 21 and a tenter 22.

Once weaving is completed on the loom 21 using the process which is the subject of the invention, the fabric produced has some elasticity. However, maximum elasticity is achieved when the fabric is further processed in a tenter 22 at a temperature in excess of 100° C. and saturated in wet steam. This process acts on the elastic wefts to increase their elasticity by 100%.

With the specifications for this process to manufacture figured, elastic fabric deemed to be broadly described, it remains only to record the possibility that the different component parts may be manufactured with a variety of materials suitable to each case, and the adoption of diverse designs and figures, with variation of the number of elastic fibers in relation to rigid fibers to ensure the appropriate elasticity. Variations of a constructive type may also be introduced as suggested by practice, provided that they are not capable of altering the essential points in accordance with the claims of the present invention which follow.

What is claimed is:

1. A process of manufacturing a figured, elastic fabric comprising the steps of:

preparing a design program for a relief pattern on fabric to be woven on a loom;

providing weft and warp threads to be used by said loom;

wherein a majority of said weft threads are made of elastic material and a minority of said weft threads are made of non-elastic material;

applying tension to said weft threads sufficient to stretch said elastic weft threads;

shedding and interlacing said warp and weft threads on said loom according to said design program;

providing floats along a plurality of said elastic weft threads thereby forming said relief pattern throughout said fabric according to said design program, each of said floats passing on one side of said fabric over a plurality of adjacent warp threads and extending inside a respective pair of binding points; and interlacing said warp and elastic weft threads outside said pairs of binding points.

2. The method as claimed in claim 1 wherein a ratio of elastic weft threads to non-elastic weft threads is approximately equal to or greater than 2.

3. The method as claimed in claim 1 further comprising the step of steaming said fabric in a tenter.

4. The method as claimed in claim 3 wherein said step of steaming is performed at or above approximately 100 degrees Celsius.

5. The method as claimed in claim 1 wherein a majority of said warp threads are made of elastic material.

6. A process of manufacturing a figured, elastic fabric comprising the steps of:

preparing a design program for a fabric to be woven on a loom;

providing weft and warp threads to be used by said loom;

wherein a substantial proportion of said weft threads are made of elastic material;

applying tension to said weft threads sufficient to stretch said elastic weft threads;

shedding and interlacing said warp and weft threads throughout said fabric according to said design program;

providing floats in said elastic weft threads throughout said fabric according to said fabric design program; and increasing elasticity of said elastic weft threads by steaming said fabric in a tenter.

7. The method as claimed in claim 6 wherein a ratio of elastic weft threads to non-elastic weft threads is approximately equal to or greater than 2.

8. The method as claimed in claim 6 wherein said step of steaming is performed at or above approximately 100 degrees Celsius.

9. The method as claimed in claim 6 wherein a majority of said warp threads are made of elastic material.

10. A woven, figured, elastic fabric comprising:

a plurality of weft threads comprising weft threads made from elastic material interspersed with weft threads made from non-elastic material; and a plurality of warp threads interlaced with said non-elastic weft threads;

said elastic weft threads including floats alone a plurality of said elastic weft threads, each of said floats passing on one side of said fabric over a plurality of adjacent warp threads and extending inside a respective pair of binding points; and said warp and elastic weft threads being interlaced outside said pairs of binding points.

11. A fabric as claimed in claim 10 wherein said fabric comprises a pattern in relief.

12. A fabric as claimed in claim 10 wherein a ratio of elastic weft threads to non-elastic weft threads is at least 2 to 1.

13. A fabric as claimed in claim 10 wherein a majority of said warp threads are made from elastic material and are interspersed with warp threads made from non-elastic material.

14. A fabric as claimed in claim 10 wherein said elastic weft threads enable said fabric to be stretched in a direction parallel to said weft threads.

15. A fabric as claimed in claim 13 wherein said elastic weft threads enable said fabric to be stretched in a direction parallel to said weft threads, and said elastic warp threads enable said fabric to be stretched parallel to said warp threads.

16. The method as claimed in claim 1 wherein the tension applied to said elastic weft threads and said non-elastic weft threads is equal.

17. The method as claimed in claim 6 wherein the tension applied to said elastic weft threads and said non-elastic weft threads is equal.

* * * * *

UNITED STATES PATENT AND TRADEMARK OFFICE

CERTIFICATE OF CORRECTION

PATENT NO. : 5,749,400

DATED : May 12, 1998

INVENTOR(S) : D. Samuel Botella Pascual

It is certified that error appears in the above-identified patent and that said Letters Patent is hereby corrected as shown below:

On the title page:

Inventor, Item [75], delete "D. Samual Botella Pascual, Alicante, Spain" and insert --D. Samuel Botella Pascual, Alicante, Spain--. Also, Assignee, Item [73], delete "M. Hidalgo Beistequi, S.A., Alicante, Spain" and insert --M. Hidalgo Beistegui, S.A., Alicante, Spain--.

Signed and Sealed this

Twentieth Day of April, 1999

*Attest:*

*Attesting Officer*

Q. TODD DICKINSON

*Acting Commissioner of Patents and Trademarks*